US009307578B2

(12) United States Patent
Pease

(10) Patent No.: US 9,307,578 B2
(45) Date of Patent: Apr. 5, 2016

(54) SYSTEM AND METHOD FOR MONITORING TEMPERATURES OF AND CONTROLLING MULTIPLEXED HEATER ARRAY

(75) Inventor: John Pease, San Mateo, CA (US)

(73) Assignee: LAM RESEARCH CORPORATION, Fremont, CA (US)

( * ) Notice: Subject to any disclaimer, the term of this patent is extended or adjusted under 35 U.S.C. 154(b) by 752 days.

(21) Appl. No.: 13/587,454

(22) Filed: Aug. 16, 2012

(65) Prior Publication Data

US 2014/0048529 A1 Feb. 20, 2014

Related U.S. Application Data

(60) Provisional application No. 61/524,546, filed on Aug. 17, 2011.

(51) Int. Cl.
*H05B 1/02* (2006.01)

(52) U.S. Cl.
CPC ..... *H05B 1/0233* (2013.01)

(58) Field of Classification Search
CPC .. H05B 1/0233; H05B 1/0297; H05B 3/0047; H05B 3/0085; H05B 3/68; H05B 2203/005
USPC ..... 219/494, 483–486, 446.1, 448.1, 219/448.11, 497, 501, 508
See application file for complete search history.

(56) References Cited

U.S. PATENT DOCUMENTS 3,440,883 A 4/1969 Lightner
4,099,228 A 7/1978 Cohn
5,059,770 A 10/1991 Mahawili
5,255,520 A 10/1993 O'Geary et al.
5,414,245 A 5/1995 Hackleman (Continued)

FOREIGN PATENT DOCUMENTS

JP 2005123286 A 5/2005
JP 2005294237 A 10/2005
KR 20080058109 A 6/2008

OTHER PUBLICATIONS

Commonly-Owned Utility U.S Appl. No. 13/234,473, filed Sep. 16, 2011.

(Continued)

*Primary Examiner* — Mark Paschall
(74) *Attorney, Agent, or Firm* — Buchanan, Ingersoll & Rooney PC

(57) ABSTRACT

A system for measuring temperatures of and controlling a multi-zone heating plate in a substrate support assembly used to support a semiconductor substrate in a semiconductor processing includes a current measurement device and switching arrangements. A first switching arrangement connects power return lines selectively to an electrical ground, a voltage supply or an electrically isolated terminal, independent of the other power return lines. A second switching arrangement connects power supply lines selectively to the electrical ground, a power supply, the current measurement device or an electrically isolated terminal, independent of the other power supply lines. The system can be used to maintain a desired temperature profile of the heater plate by taking current readings of reverse saturation currents of diodes serially connected to planar heating zones, calculating temperatures of the heating zones and powering each heater zone to achieve the desired temperature profile.

19 Claims, 6 Drawing Sheets

(56) References Cited

U.S. PATENT DOCUMENTS

| | | | | |
|---|---|---|---|---|
| 5,504,471 | A | 4/1996 | Lund | |
| 5,515,683 | A | 5/1996 | Kessler | |
| 5,536,918 | A | 7/1996 | Ohkase et al. | |
| 5,635,093 | A | 6/1997 | Arena et al. | |
| 5,665,166 | A | 9/1997 | Deguchi et al. | |
| 5,667,622 | A | 9/1997 | Hasegawa et al. | |
| 5,740,016 | A | 4/1998 | Dhindsa | |
| 5,802,856 | A | 9/1998 | Schaper et al. | |
| 5,851,298 | A | 12/1998 | Ishii | |
| 5,886,866 | A | 3/1999 | Hausmann | |
| 6,060,697 | A | 5/2000 | Morita et al. | |
| 6,095,084 | A | 8/2000 | Shamouilian et al. | |
| 6,100,506 | A | 8/2000 | Colelli, Jr. et al. | |
| 6,175,175 | B1 | 1/2001 | Hull | |
| 6,222,161 | B1 | 4/2001 | Shirakawa et al. | |
| 6,271,459 | B1 | 8/2001 | Yoo | |
| 6,332,710 | B1 | 12/2001 | Aslan et al. | |
| 6,342,997 | B1 | 1/2002 | Khadkikar et al. | |
| 6,353,209 | B1 | 3/2002 | Schaper et al. | |
| 6,403,403 | B1 * | 6/2002 | Mayer et al. | 438/132 |
| 6,475,336 | B1 | 11/2002 | Hubacek | |
| 6,483,690 | B1 | 11/2002 | Nakajima et al. | |
| 6,512,207 | B1 | 1/2003 | Dress et al. | |
| 6,523,493 | B1 | 2/2003 | Brcka | |
| 6,566,632 | B1 | 5/2003 | Katata et al. | |
| 6,612,673 | B1 | 9/2003 | Giere et al. | |
| 6,664,515 | B2 | 12/2003 | Natsuhara et al. | |
| 6,739,138 | B2 | 5/2004 | Saunders et al. | |
| 6,740,853 | B1 | 5/2004 | Johnson et al. | |
| 6,741,446 | B2 | 5/2004 | Ennis | |
| 6,746,616 | B1 | 6/2004 | Fulford et al. | |
| 6,795,292 | B2 | 9/2004 | Grimard et al. | |
| 6,815,365 | B2 | 11/2004 | Masuda et al. | |
| 6,825,617 | B2 | 11/2004 | Kanno et al. | |
| 6,835,290 | B2 | 12/2004 | Reiter et al. | |
| 6,847,014 | B1 | 1/2005 | Benjamin et al. | |
| 6,870,728 | B1 | 3/2005 | Burket et al. | |
| 6,886,347 | B2 | 5/2005 | Hudson et al. | |
| 6,921,724 | B2 | 7/2005 | Kamp et al. | |
| 6,979,805 | B2 | 12/2005 | Arthur et al. | |
| 6,985,000 | B2 | 1/2006 | Feder et al. | |
| 6,989,210 | B2 | 1/2006 | Gore | |
| 7,075,031 | B2 | 7/2006 | Strang et al. | |
| 7,141,763 | B2 | 11/2006 | Moroz | |
| 7,173,222 | B2 | 2/2007 | Cox et al. | |
| 7,175,714 | B2 | 2/2007 | Ootsuka et al. | |
| 7,206,184 | B2 | 4/2007 | Ennis | |
| 7,230,204 | B2 | 6/2007 | Mitrovic et al. | |
| 7,250,309 | B2 | 7/2007 | Mak et al. | |
| 7,268,322 | B2 | 9/2007 | Kuibira et al. | |
| 7,274,004 | B2 | 9/2007 | Benjamin et al. | |
| 7,275,309 | B2 | 10/2007 | Matsuda et al. | |
| 7,279,661 | B2 | 10/2007 | Okajima et al. | |
| 7,297,894 | B1 | 11/2007 | Tsukamoto | |
| 7,311,782 | B2 | 12/2007 | Strang et al. | |
| 7,372,001 | B2 | 5/2008 | Tachikawa et al. | |
| 7,396,431 | B2 | 7/2008 | Chen et al. | |
| 7,415,312 | B2 | 8/2008 | Barnett, Jr. et al. | |
| 7,430,984 | B2 * | 10/2008 | Hanawa et al. | 118/723 I |
| 7,475,551 | B2 | 1/2009 | Ghoshal | |
| 7,480,129 | B2 | 1/2009 | Brown et al. | |
| 7,504,006 | B2 | 3/2009 | Gopalraja et al. | |
| 7,512,359 | B2 | 3/2009 | Sugiyama | |
| 7,718,932 | B2 | 5/2010 | Steger | |
| 7,782,583 | B2 | 8/2010 | Moon | |
| 7,893,387 | B2 | 2/2011 | Ohata | |
| 7,940,064 | B2 | 5/2011 | Segawa et al. | |
| 7,952,049 | B2 | 5/2011 | Tsukamoto | |
| 7,968,825 | B2 | 6/2011 | Jyousaka et al. | |
| 8,057,602 | B2 | 11/2011 | Koelmel et al. | |
| 8,136,820 | B2 | 3/2012 | Morioka et al. | |
| 8,168,050 | B2 | 5/2012 | Lu | |
| 8,207,476 | B2 | 6/2012 | Tsukamoto et al. | |
| 8,222,574 | B2 | 7/2012 | Sorabji et al. | |
| 8,536,492 | B2 * | 9/2013 | Ramamurthy et al. | 219/390 |
| 2002/0043528 | A1 | 4/2002 | Ito | |
| 2005/0016465 | A1 | 1/2005 | Ramaswamy et al. | |
| 2005/0215073 | A1 | 9/2005 | Nakamura et al. | |
| 2005/0229854 | A1 | 10/2005 | Moroz | |
| 2006/0191637 | A1 | 8/2006 | Zajac et al. | |
| 2006/0226123 | A1 | 10/2006 | Birang | |
| 2007/0000918 | A1 | 1/2007 | Steinhauser et al. | |
| 2007/0125762 | A1 | 6/2007 | Cui et al. | |
| 2008/0202924 | A1 | 8/2008 | Bluck et al. | |
| 2009/0000738 | A1 | 1/2009 | Benjamin | |
| 2009/0173445 | A1 | 7/2009 | Yeom et al. | |
| 2009/0183677 | A1 | 7/2009 | Tian et al. | |
| 2010/0116788 | A1 | 5/2010 | Singh et al. | |
| 2010/0257871 | A1 | 10/2010 | Venkatasubramanian et al. | |
| 2010/0283565 | A1 | 11/2010 | Blakes | |
| 2011/0005682 | A1 | 1/2011 | Savas et al. | |
| 2011/0033175 | A1 | 2/2011 | Kasai et al. | |
| 2011/0092072 | A1 | 4/2011 | Singh et al. | |
| 2011/0108706 | A1 | 5/2011 | Koyama | |
| 2011/0143462 | A1 | 6/2011 | Gaff et al. | |
| 2012/0097661 | A1 | 4/2012 | Singh | |
| 2012/0115254 | A1 | 5/2012 | Singh | |

OTHER PUBLICATIONS

Commonly-Owned Utility U.S. Appl. No. 13/237,444, filed Sep. 20, 2011.

Commonly-Owned Utility U.S. Appl. No. 13/238,396, filed Sep. 21, 2011.

Commonly-Owned Utility U.S. Appl. No. 13/406,978, filed Feb. 28, 2012.

Commonly-Owned Utility U.S. Appl. No. 13/446,335, filed Apr. 13, 2012.

International Search Report and Written Opinion mailed Oct. 23, 2012 for PCT/US2012/051029.

Ayars, Eric, "Bandgap in a Semiconductor Diode", Advanced and Intermediate Instructional Labs Workshop, AAPT Summer Meeting, California State university, Chicago, Jul. 20, 2008 http://phys.csuchico.edu/-eayars/publications/bandgap.pdf.

* cited by examiner

SYSTEM AND METHOD FOR MONITORING TEMPERATURES OF AND CONTROLLING MULTIPLEXED HEATER ARRAY

This application claims priority under 35 U.S.C. §119(e) to U.S. Provisional Application No. 61/524,546 entitled A SYSTEM AND METHOD FOR MONITORING TEMPERATURES OF AND CONTROLLING MULTIPLEXED HEATER ARRAY, filed Aug. 17, 2011, the entire content of which is hereby incorporated by reference.

BACKGROUND

With each successive semiconductor technology generation, substrate diameters tend to increase and transistor sizes decrease, resulting in the need for an ever higher degree of accuracy and repeatability in substrate processing. Semiconductor substrate materials, such as silicon substrates, are processed by techniques which include the use of vacuum chambers. These techniques include non-plasma applications such as electron beam deposition, as well as plasma applications, such as sputter deposition, plasma-enhanced chemical vapor deposition (PECVD), resist strip, and plasma etch.

Plasma processing systems available today are among those semiconductor fabrication tools which are subject to an increasing need for improved accuracy and repeatability. One metric for plasma processing systems is increased uniformity, which includes uniformity of process results on a semiconductor substrate surface as well as uniformity of process results of a succession of substrates processed with nominally the same input parameters. Continuous improvement of on-substrate uniformity is desirable. Among other things, this calls for plasma chambers with improved uniformity, consistency and self diagnostics.

SUMMARY OF THE INVENTION

Described herein is a system operable to measure temperatures of and control a multi-zone heating plate in a substrate support assembly used to support a semiconductor substrate in a semiconductor processing apparatus, the heating plate comprising a plurality of planar heater zones, a plurality of diodes, a plurality of power supply lines and a plurality of power return lines, wherein each planar heater zone is connected to one of the power supply lines and one of the power return lines, and no two planar heater zones share the same pair of power supply line and power return line, and a diode is serially connected between each planar heater zone and the power supply line connected thereto or between each planar heater zone and the power return line connected thereto such that the diode does not allow electrical current flow in a direction from the power return line through the planar heater zone to the power supply line; the system comprising: a current measurement device; a first switching arrangement configured to connect each of the power return lines selectively to an electrical ground, a voltage supply or an electrically isolated terminal, independent of the other power return lines; and a second switching arrangement configured to connect each of the power supply lines selectively to the electrical ground, a power supply, the current measurement device or an electrically isolated terminal, independent of the other power supply lines.

DETAILED DESCRIPTION

Figure 1:
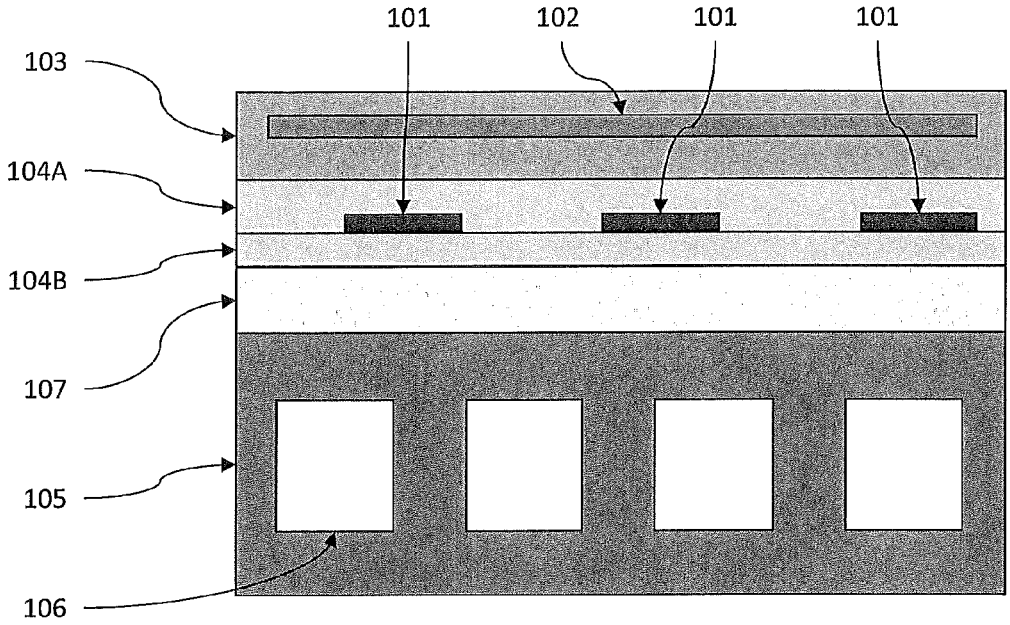
FIG. 1 is a schematic of the cross-sectional view of a substrate support assembly in which a heating plate with an array of planar heater zones is incorporated, the substrate support assembly also comprising an electrostatic chuck (ESC).

Radial and azimuthal substrate temperature control in a semiconductor processing apparatus to achieve desired critical dimension (CD) uniformity on the substrate is becoming more demanding. Even a small variation of temperature may affect CD to an unacceptable degree, especially as CD approaches sub-100 nm in semiconductor fabrication processes.

A substrate support assembly may be configured for a variety of functions during processing, such as supporting the substrate, tuning the substrate temperature, and supplying radio frequency power. The substrate support assembly can comprise an electrostatic chuck (ESC) useful for electrostatically clamping a substrate onto the substrate support assembly during processing. The ESC may be a tunable ESC (T-ESC). A T-ESC is described in commonly assigned U.S. Pat. Nos. 6,847,014 and 6,921,724, which are hereby incorporated by reference. The substrate support assembly may comprise a ceramic substrate holder, a fluid-cooled heat sink (hereafter referred to as cooling plate) and a plurality of concentric planar heater zones to realize step by step and radial temperature control. Typically, the cooling plate is maintained between 0° C. and 30° C. The heaters are located on the cooling plate with a layer of thermal insulator in between. The heaters can maintain the support surface of the substrate support assembly at temperatures about 0° C. to 80° C. above the cooling plate temperature. By changing the heater power within the plurality of planar heater zones, the substrate support temperature profile can be changed between center hot, center cold, and uniform. Further, the mean substrate support temperature can be changed step by step within the operating range of 0 to 80° C. above the cooling plate temperature. A small azimuthal temperature variation poses increasingly greater challenges as CD decreases with the advance of semiconductor technology.

Controlling temperature is not an easy task for several reasons. First, many factors can affect heat transfer, such as the locations of heat sources and heat sinks, the movement, materials and shapes of the media. Second, heat transfer is a dynamic process. Unless the system in question is in heat equilibrium, heat transfer will occur and the temperature profile and heat transfer will change with time. Third, non-equilibrium phenomena, such as plasma, which of course is always present in plasma processing, make theoretical prediction of the heat transfer behavior of any practical plasma processing apparatus very difficult if not impossible.

The substrate temperature profile in a plasma processing apparatus is affected by many factors, such as the plasma density profile, the RF power profile and the detailed structure of the various heating the cooling elements in the chuck, hence the substrate temperature profile is often not uniform and difficult to control with a small number of heating or cooling elements. This deficiency translates to non-uniformity in the processing rate across the whole substrate and non-uniformity in the critical dimension of the device dies on the substrate.

In light of the complex nature of temperature control, it would be advantageous to incorporate multiple independently controllable planar heater zones in the substrate support assembly to enable the apparatus to actively create and maintain the desired spatial and temporal temperature profile, and to compensate for other adverse factors that affect CD uniformity.

A heating plate for a substrate support assembly in a semiconductor processing apparatus with multiple independently controllable planar heater zones is disclosed in commonly-owned U.S. Patent Publication No. 2011/0092072, the disclosure of which is hereby incorporated by reference. This heating plate comprises a scalable multiplexing layout scheme of the planar heater zones and the power supply and power return lines. By tuning the power of the planar heater zones, the temperature profile during processing can be shaped both radially and azimuthally. Although this heating plate is primarily described for a plasma processing apparatus, this heating plate can also be used in other semiconductor processing apparatuses that do not use plasma.

The planar heater zones in this heating plate are preferably arranged in a defined pattern, for example, a rectangular grid, a hexagonal grid, a polar array, concentric rings or any desired pattern. Each planar heater zone may be of any suitable size and may have one or more heater elements. In certain embodiments, all heater elements in a planar heater zone are turned on or off together. To minimize the number of electrical connections, power supply lines and power return lines are arranged such that each power supply line is connected to a different group of planar heater zones, and each power return line is connected to a different group of planar heater zones wherein each planar heater zone is in one of the groups connected to a particular power supply line and one of the groups connected to a particular power return line. In certain embodiments, no two planar heater zones are connected to the same pair of power supply and power return lines. Thus, a planar heater zone can be activated by directing electrical current through a pair of power supply and power return lines to which this particular planar heater zone is connected. The power of the heater elements is preferably smaller than 20 W, more preferably 5 to 10 W. The heater elements may be resistive heaters, such as polyimide heaters, silicone rubber heaters, mica heaters, metal heaters (e.g. W, Ni/Cr alloy, Mo or Ta), ceramic heaters (e.g. WC), semiconductor heaters or carbon heaters. The heater elements may be screen printed, wire wound or etched foil heaters. In one embodiment, each planar heater zone is not larger than four device dies being manufactured on a semiconductor substrate, or not larger than two device dies being manufactured on a semiconductor substrate, or not larger than one device die being manufactured on a semiconductor substrate, or from 16 to 100 $cm^2$ in area, or from 1 to 15 $cm^2$ in area, or from 2 to 3 $cm^2$ in area to correspond to the device dies on the substrate. The thickness of the heater elements may range from 2 micrometers to 1 millimeter, preferably 5-80 micrometers. To allow space between planar heater zones and/or power supply and power return lines, the total area of the planar heater zones may be up to 90% of the area of the upper surface of the substrate support assembly, e.g. 50-90% of the area. The power supply lines or the power return lines (power lines, collectively) may be arranged in gaps ranging from 1 to 10 mm between the planar heater zones, or in separate planes separated from the planar heater zones plane by electrically insulating layers. The power supply lines and the power return lines are preferably made as wide as the space allows, in order to carry large current and reduce Joule heating. In one embodiment, in which the power lines are in the same plane as the planar heater zones, the width of the power lines is preferably between 0.3 mm and 2 mm. In another embodiment, in which the power lines are on different planes than the planar heater zones, the width of the power lines can be as large as the planar heater zones, e.g. for a 300 mm chuck, the width can be 1 to 2 inches. The materials of the power lines may be the same as or different from the materials of the heater elements. Preferably, the materials of the power lines are materials with low resistivity, such as Cu, Al, W, Inconel® or Mo.

Figure 2:
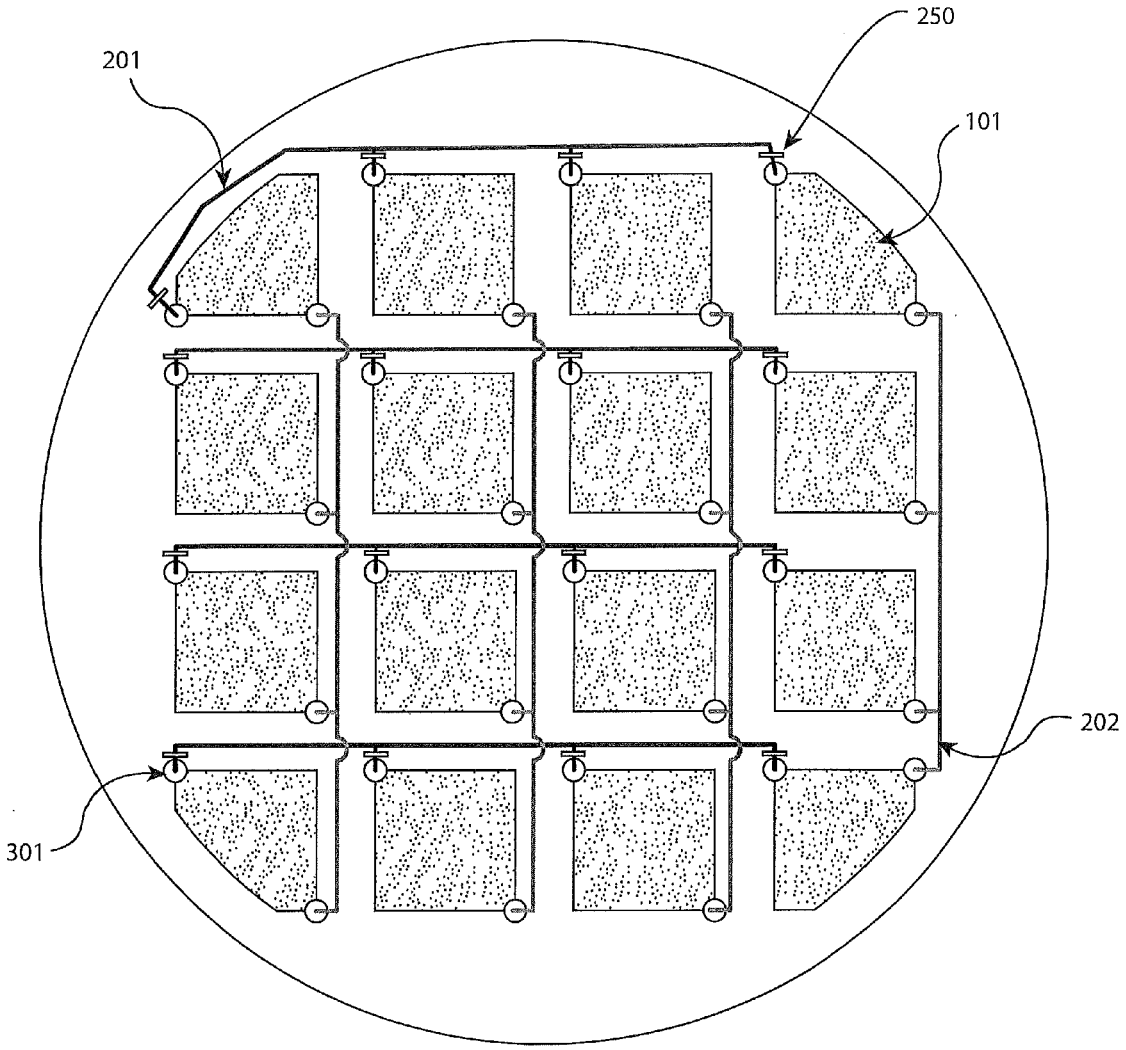
FIG. 2 illustrates the topological connection between power supply and power return lines to an array of planar heater zones in one embodiment of a heating plate which can be incorporated in a substrate support assembly.

FIGS. 1-2 show a substrate support assembly comprising one embodiment of the heating plate having an array of planar heater zones 101 incorporated in two electrically insulating layers 104A and 1048. The electrically insulating layers may be a polymer material, an inorganic material, a ceramic such as silicon oxide, alumina, yttria, aluminum nitride or other suitable material. The substrate support assembly further comprises (a) an ESC having a ceramic layer 103 (electrostatic clamping layer) in which an electrode 102 (e.g. monopolar or bipolar) is embedded to electrostatically clamp a substrate to the surface of the ceramic layer 103 with a DC voltage, (b) a thermal barrier layer 107, (c) a cooling plate 105 containing channels 106 for coolant flow.

As shown in FIG. 2, each of the planar heater zones 101 is connected to one of the power supply lines 201 and one of the power return lines 202. No two planar heater zones 101 share the same pair of power supply 201 line and power return 202 line. By suitable electrical switching arrangements, it is possible to connect a pair of power supply 201 and power return 202 lines to a power supply (not shown), whereby only the planar heater zone connected to this pair of lines is turned on. The time-averaged heating power of each planar heater zone can be individually tuned by time-domain multiplexing. In order to prevent crosstalk between different planar heater zones, a diode 250 is serially connected between each planar heater zone 101 and the power supply line 201 connected thereto (as shown in FIG. 2), or between each planar heater zone 101 and the power return line 202 connected thereto (not shown) such that the diode 250 does not allow electrical current flow in a direction from the power return line 201 through the planar heater zone 101 to the power supply line 202. The diode 250 is physically located in or adjacent the planar heater zone.

A substrate support assembly can comprise an embodiment of the heating plate, wherein each planar heater zone of the heating plate is of similar size to or smaller than a single device die or group of device dies on the substrate so that the substrate temperature, and consequently the plasma etching process, can be controlled for each device die position to maximize the yield of devices from the substrate. The heating plate can include 10-100, 100-200, 200-300 or more planar heating zones. The scalable architecture of the heating plate can readily accommodate the number of planar heater zones required for die-by-die substrate temperature control (typically more than 100 dies on a substrate of 300 mm diameter and thus 100 or more heater zones) with minimal number of power supply lines, power return lines, and feedthroughs in the cooling plate, thus reducing disturbance to the substrate temperature, the cost of manufacturing, and the complexity of the substrate support assembly. Although not shown, the substrate support assembly can comprise features such as lift pins for lifting the substrate, helium back cooling, temperature sensors for providing temperature feedback signals, voltage and current sensors for providing heating power feedback signals, power feed for heaters and/or clamp electrode, and/or RF filters.

Figure 3:
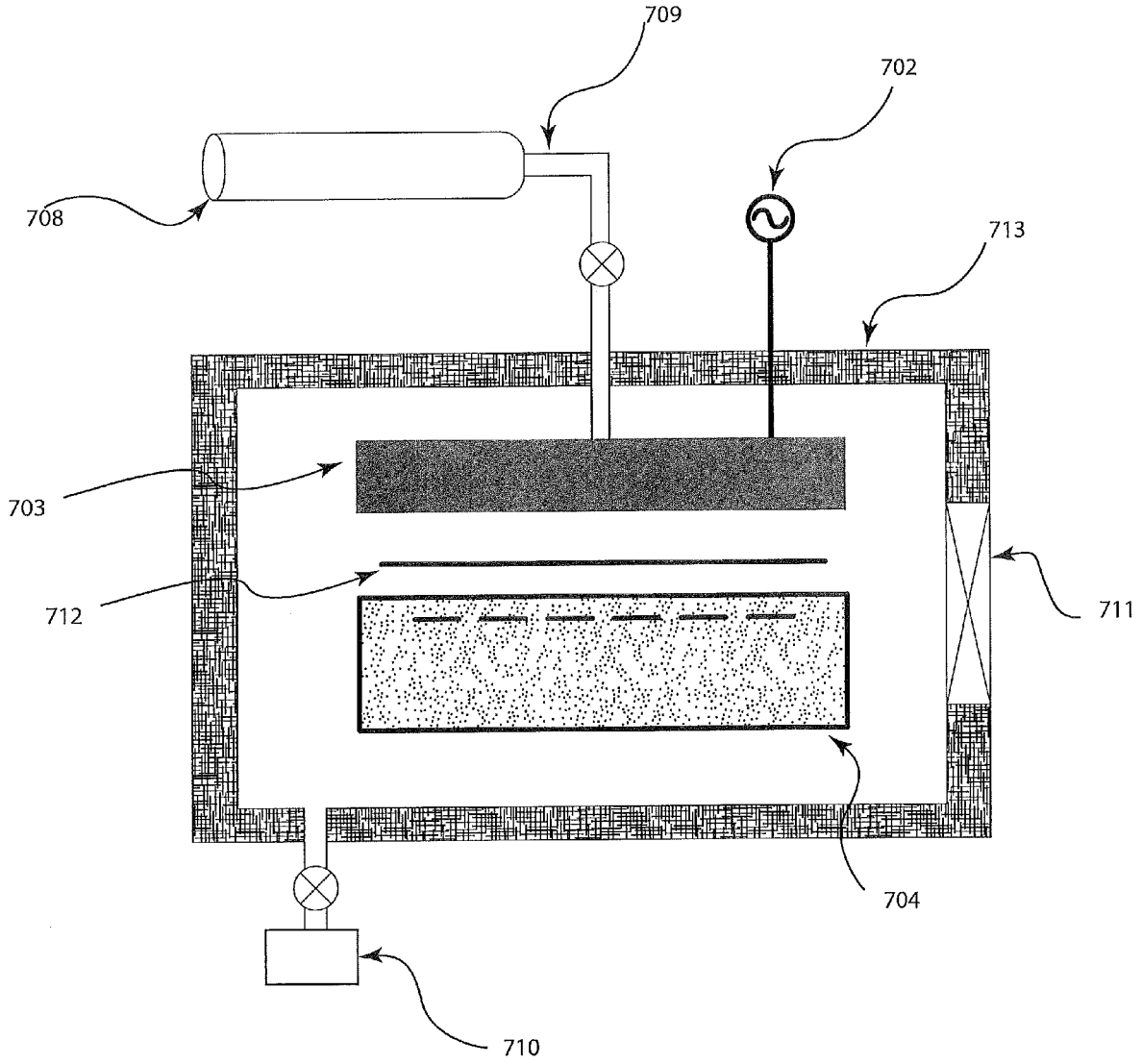
FIG. 3 is a schematic of an exemplary plasma processing chamber, which can include a substrate support assembly described herein.

As an overview of how a plasma processing chamber operates, FIG. 3 shows a schematic of a plasma processing chamber comprising a chamber 713 in which an upper showerhead electrode 703 and a substrate support assembly 704 are disposed. A substrate 712 is loaded through a loading port 711 onto the substrate support assembly 704. A gas line 709 supplies process gas to the upper showerhead electrode 703 which delivers the process gas into the chamber. A gas source 708 (e.g. a mass flow controller power supplying a suitable gas mixture) is connected to the gas line 709. A RF power source 702 is connected to the upper showerhead electrode 703. In operation, the chamber is evacuated by a vacuum pump 710 and the RF power is capacitively coupled between the upper showerhead electrode 703 and a lower electrode in the substrate support assembly 704 to energize the process gas into a plasma in the space between the substrate 712 and the upper showerhead electrode 703. The plasma can be used to etch device die features into layers on the substrate 712. The substrate support assembly 704 may have heaters incorporated therein. It should be appreciated that while the detailed design of the plasma processing chamber may vary, RF power is coupled to the plasma through the substrate support assembly 704.

Figure 4:
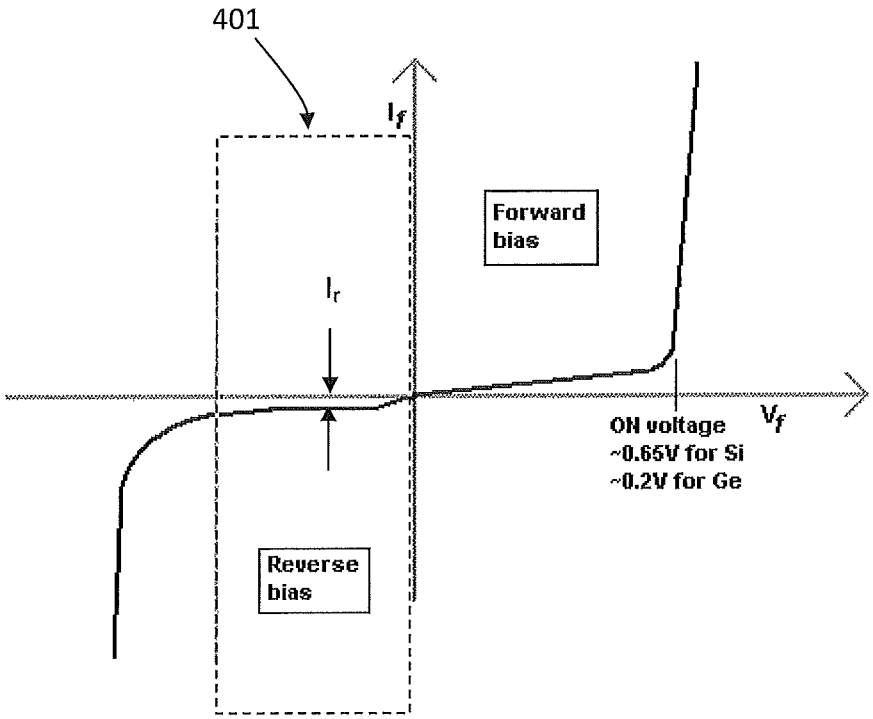
FIG. 4 shows exemplary current-voltage characteristics (I-V curve) of a diode connected to a planar heater zone in the heating plate.

Electrical power supplied to each planar heater zone 101 can be adjusted based on the actual temperature thereof in order to achieve a desired substrate support temperature profile. The actual temperature at each planar heater zone 101 can be monitored by measuring a reverse saturation current of the diode 250 connected thereto. FIG. 4 shows exemplary current-voltage characteristics (I-V curve) of the diode 250. When the diode 250 is in its reversed bias region (the region as marked by the shaded box 401), the electrical current through the diode 250 is essentially independent from the bias voltage on the diode 250. The magnitude of this electrical current is called the reverse saturation current $I_r$. Temperature dependence of $I_r$, can be approximated as:

$$I_r = A \cdot T^{3+\gamma/2} \cdot e^{-E_g/kT} \quad \text{(Eq. 1);}$$

wherein A is the area of the junction in the diode 250; T is the temperature in Kelvin of the diode 250; γ is a constant; $E_g$ is the energy gap of the material composing the junction ($E_g$=1.12 eV for silicon); k is Boltzmann's constant.

Figure 5:
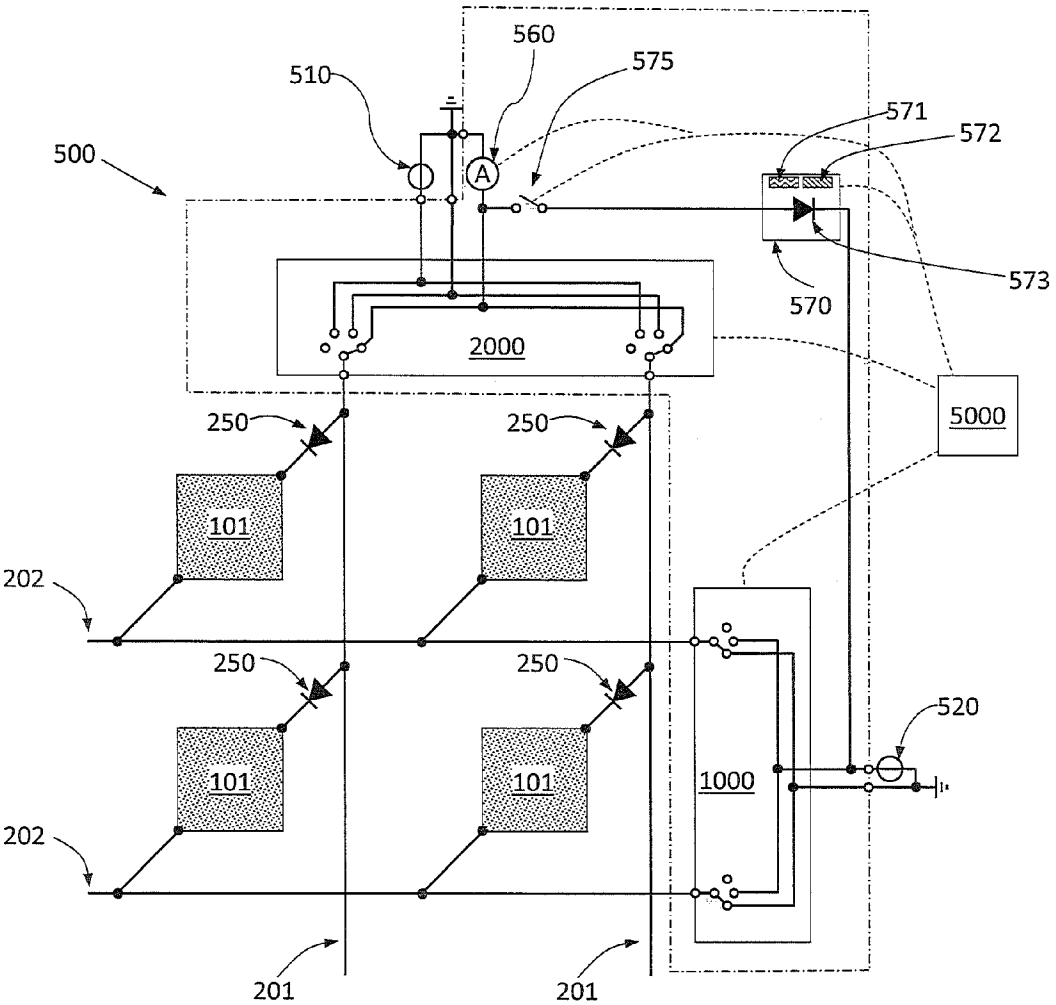
FIG. 5 shows a circuit diagram of a system, according to an embodiment, configured to control the heating plate and monitor temperature of each planar heater zone therein.

FIG. 5 shows a circuit diagram of a system 500 configured to control the heating plate and monitor temperature of each planar heater zone 101 therein by measuring the reverse saturation current $I_r$ of the diode 250 connected to each planar heater zone 101. For simplicity, only four planar heater zones are shown. This system 500 can be configured to work with any number of planar heater zones.

The system 500 comprises a current measurement device 560, a switching arrangement 1000, a switching arrangement 2000, an optional on-off switch 575, an optional calibration device 570. The switching arrangement 1000 is configured to connect each power return line 202 selectively to the electrical ground, a voltage source 520 or an electrically isolated terminal, independent of the other power return lines. The switching arrangement 2000 is configured to selectively connect each power supply line 201 to an electrical ground, a power source 510, the current measurement device 560 or an electrically isolated terminal, independent of the other power supply lines. The voltage source 520 supplies non-negative voltage. The optional calibration device 570 can be provided for calibrating the relationship between the reverse saturation current $I_r$ of each diode 250 and its temperature T. The calibration device 570 comprises a calibration heater 571 thermally isolated from the planar heater zones 101 and the diodes 250, a calibrated temperature meter 572 (e.g. a thermal couple) and a calibration diode 573 of the same type as (preferably identical to) the diodes 250. The calibration device 570 can be located in the system 500. The calibration heater 571 and the temperature meter 572 can be powered by the voltage source 520. The cathode of the calibration diode 573 is configured to connect to the voltage source 520 and the anode is connected to the current measurement device 560 through the on-off switch 575 (i.e. the calibration diode 573 is reverse biased). The calibration heater 571 maintains the calibration diode 573 at a temperature close to operating temperatures of the planar heater zones 101 (e.g. 20 to 200° C.). A processor 5000 (e.g. a micro controller unit, a computer, etc.) controls the switching arrangement 1000 and 2000, the calibration device 570 and the switch 575, receives current readings from the current measurement device 560, and receives temperature readings from the calibration device 570. If desired, the processor 5000 can be included in the system 500.

Figure 6:
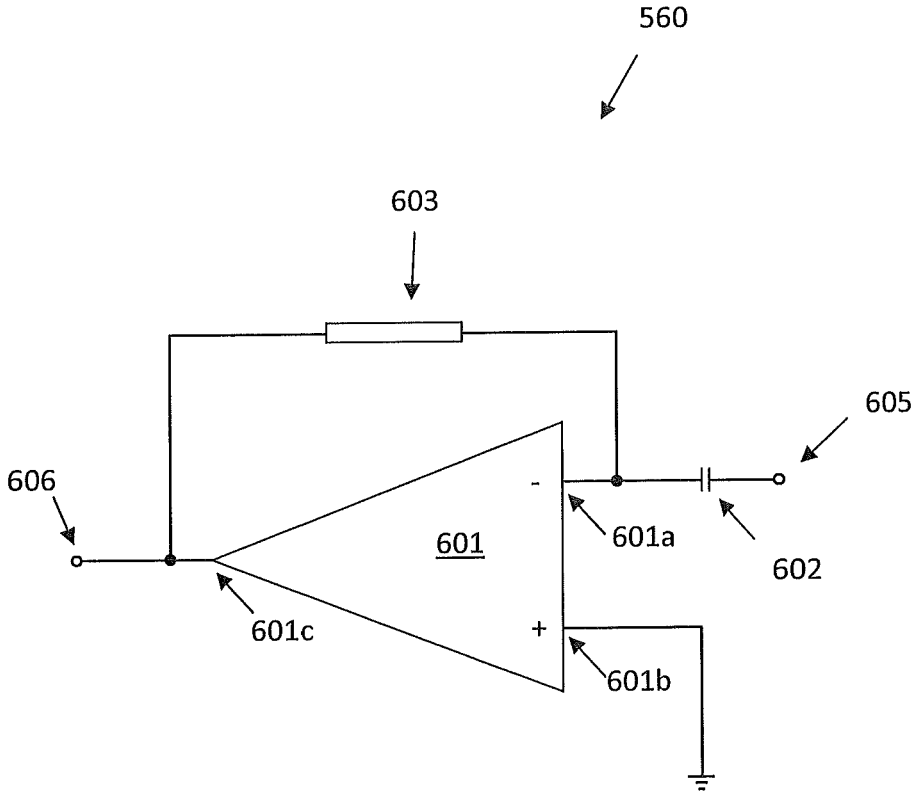
FIG. 6 shows a circuit diagram of a current measurement device in the system in FIG. 5.

The current measurement device 560 can be any suitable device such as an amp meter or a device based on an operational amplifier (op amp) as shown in FIG. 6. An electrical current to be measured flows to an input terminal 605, which is connected to the inverting input 601*a* of an op amp 601 through an optional capacitor 602. The inverting input 601*a* of the op amp 601 is also connected to the output 601*c* of the op amp 601 through a resistor 603 of a resistance R1. The non-inverting input 601*b* of the op amp 601 is connected to electrical ground. Voltage Von an output terminal 606 connected to the output of the op amp 601 is a reading of the current I, wherein V=I·R1. The device shown in FIG. 6 converts a current signal of a diode (one of the diodes 250 or the calibration diode 573) on the input terminal 605 to a voltage signal on the output terminal 606 to be sent to the processor 5000 as a temperature reading.

A method for measuring temperatures of and controlling the heating template comprises a temperature measurement step that includes connecting the power supply line 201 connected to a planar heater zone 101 to the current measurement device 560, connecting all the other power supply line(s) to electrical ground, connecting the power return line 202 connected to the planar heater zone 101 to the voltage source 520, connecting all the other power return line(s) to an electrically isolated terminal, taking a current reading of a reverse saturation current of the diode 250 serially connected to the planar heater zone 101 from the current measurement device 560, calculating the temperature T of the planar heater zone 101 from the current reading based on Eq. 1, deducing a setpoint temperature $T_0$ for the planar heater zone 101 from a desired temperature profile for the entire heating plate, calculating a time duration t such that powering the planar heater zone 101 with the power supply 510 for the duration t changes the temperature of the planar heater zone 101 from T to $T_0$. Connecting all the power supply lines not connected to the planar heater zone 101 to electrical ground guarantees that only the reverse saturation current from the diode 250 connected to the planar heater zone 101 reaches the current measurement device 560.

The method further comprises a powering step after the temperature measurement step, the powering step including maintaining a connection between the power supply line 201 connected to the planar heater zone 101 and the power supply 510 and a connection between the power return line 202 connected to the planar heater zone 101 and electrical ground for the time duration t. The method can further comprise repeating the temperature measurement step and the powering step on each of the planar heater zones 101.

The method can further comprise an optional discharge step before conducting the temperature measurement step on a planar heater zone 101, the discharge step including connecting the power supply line 201 connected to the planar heater zone 101 to ground to discharge the junction capacitance of the diode 250 connected to the planar heater zone 101.

The method can further comprise an optional zero point correction step before conducting the temperature measurement step on a planar heater zone 101, the zero point correction step including connecting the power supply line 201 connected to the planar heater zone 101 to the current measurement device 560, connecting all the other power supply line(s) to the electrical ground, connecting the power return line 202 connected to the planar heater zone 101 to the electrical ground, connecting each of the other power return lines to an electrically isolated terminal, taking a current reading (zero point current) from the current measurement device 560. The zero point current can be subtracted from the current reading in the temperature measurement step, before calculating the temperature T of the planar heater zone. The zero point correction step eliminates errors resulting from any leakage current from the power supply 510 through the switching arrangement 2000. All of the measuring, zeroing and discharge steps may be performed with sufficient speed to use synchronous detection on the output of operational amplifier 601 by controller 5000 or additional synchronous detection electronics. Synchronous detection of the measured signal may reduce measurement noise and improve accuracy.

The method can further comprise an optional calibration step to correct any temporal shift of temperature dependence of the reverse saturation current of any diode 250. The calibration step includes disconnecting all power supply lines 201 and power return lines 202 from the current measurement device 560, closing the on-off switch 575, heating the calibration diode 573 with the calibration heater 571 to a temperature preferably in a working temperature range of the diodes 250, measuring the temperature of the calibration diode 573 with the calibrated temperature meter 572, measuring the reverse saturation current of the calibration diode 573, and adjusting the parameters A and $\gamma$ in Eq. 1 for each diode 250 based on the measured temperature and measured reverse saturation current.

A method of processing a semiconductor in a plasma etching apparatus comprising a substrate support assembly and the system described herein, comprises (a) supporting a semiconductor substrate on the substrate support assembly, (b) creating a desired temperature profile across the heating plate by powering the planar heater zones therein with the system, (c) energizing a process gas into a plasma, (d) etching the semiconductor with the plasma, and (e) during etching the semiconductor with the plasma maintaining the desired temperature profile using the system. In step (e), the system maintains the desired temperature profile by measuring a temperature of each planar heater zone in the heating plate and powering each planar heater zone based on its measured temperature. The system measures the temperature of each planar heater zone by taking a current reading of a reverse saturation current of the diode serially connected to the planar heater zone.

While the system 500 and a method for measuring temperatures of and controlling the heating plate have been described in detail with reference to specific embodiments thereof, it will be apparent to those skilled in the art that various changes and modifications can be made, and equivalents employed, without departing from the scope of the appended claims.

I claim:

1. A system operable to measure temperatures of and control a multi-zone heating plate in a substrate support assembly used to support a semiconductor substrate in a semiconductor processing apparatus, the heating plate comprising a plurality of planar heater zones, a plurality of diodes, a plurality of power supply lines and a plurality of power return lines, wherein each planar heater zone has at least one heater element, is connected to one of the power supply lines and one of the power return lines, and no two planar heater zones share the same pair of power supply line and power return line, and a diode is serially connected between each planar heater zone and the power supply line connected thereto or between each planar heater zone and the power return line connected thereto such that the diode does not allow electrical current flow in a direction from the power return line through the planar heater zone to the power supply line; the system comprising:

a first switching arrangement configured to connect each of the power return lines selectively to an electrical ground, a voltage supply or a first electrically isolated terminal, independent of the other power return lines;

a second switching arrangement configured to connect each of the power supply lines selectively to the electrical ground, a power supply, a current measurement device or a second electrically isolated terminal, independent of the other power supply lines, wherein the current measurement device is connected between the electrical ground and the second switching arrangement; and a calibration device connected between the current measurement device and the voltage supply, wherein the calibration device is connected to the current measurement device via an on-off switch.

2. The system of claim 1, wherein the voltage supply outputs non-negative voltage.

3. The system of claim 1, wherein the current measurement device is an amp meter and/or comprises an operational amplifier.

4. The system of claim 1, wherein the calibration device comprises a calibration heater, a calibrated temperature meter and a calibration diode whose anode is connected to the current measurement device through the on-off switch and whose cathode is configured to connect to the voltage supply.

5. The system of claim 4, wherein the calibration diode of the calibration device is identical to the diodes connected to the planar heater zones in the heating plate.

6. The system of claim 1, wherein a size of each of the planar heater zones is from 16 to 100 $cm^2$.

7. The system of claim 1, wherein the heating plate comprises 10-100, 100-200, 200-300 or more planar heating zones.

8. A plasma processing apparatus comprising a substrate support assembly and the system of claim 1, wherein the system is operable to measure temperatures of and control each heater zone of the multi-zone heating plate in the substrate support assembly used to support a semiconductor substrate in the semiconductor processing apparatus.

9. The plasma processing apparatus of claim 8, wherein the plasma processing apparatus is a plasma etching apparatus.

10. A method of calibrating the diodes in the system of claim 5, comprising:

disconnecting all power supply lines and power return lines from the current measurement device, closing the on-off switch, heating the calibration diode with the calibration heater to a temperature in a working temperature range of the diodes, measuring the temperature of the calibration diode with the calibrated temperature meter, measuring the reverse saturation current of the calibration diode, and determining at least one of parameters A and γ from (Eq. 1) wherein A is the area of the junction in the diode, T is the temperature in Kelvin of the diode, γ is a constant, Eg is the energy gap of the material composing the junction (Eg=1.12 eV for silicon), k is Boltzmann's constant for each diode based on the measured temperature and measured reverse saturation current.

11. A method of processing a semiconductor substrate in the plasma etching apparatus of claim 9, comprising: (a) supporting a semiconductor substrate on the substrate support assembly, (b) creating a desired temperature profile across the heating plate by powering the planar heater zones therein with the system, (c) energizing a process gas into a plasma, (d) etching the semiconductor substrate with the plasma, and (e) during etching the semiconductor substrate with the plasma maintaining the desired temperature profile using the system.

12. The method of claim 11, wherein, in step (e), the system maintains the desired temperature profile by measuring a temperature of each planar heater zone in the heating plate and powering each planar heater zone based on its measured temperature.

13. The method of claim 12, wherein the system measures the temperature of each planar heater zone by taking a current reading of a reverse saturation current of the diode serially connected to the planar heater zone.

14. A method of measuring temperatures of and maintaining a desired temperature profile across the system of claim 1, comprising a temperature measurement step including:

connecting the power supply line connected to one of the planar heater zones to the current measurement device, connecting all the other power supply line(s) to electrical ground, connecting the power return line connected to the planar heater zone to the voltage source, connecting all the other power return line(s) to the first electrically isolated terminal; and taking a current reading of a reverse saturation current of the diode serially connected to the planar heater zone, from the current measurement device, calculating the temperature T of the planar heater zone from the current reading, deducing a setpoint temperature T0 for the planar heater zone from a desired temperature profile for the entire heating plate, calculating a time duration t such that powering the planar heater zone with the power supply for the duration t changes the temperature of the planar heater zone from T to T0.

15. The method of claim 14, further comprising a powering step after the current measurement step, the powering step including:

maintaining a connection between the power supply line connected to the planar heater zone and the power supply and a connection between the power return line connected to the planar heater zone and electrical ground for the time duration t.

16. The method of claim 15, further comprising repeating the temperature measurement step and/or the powering step on each of the planar heater zones.

17. The method of claim 14, further comprising an optional discharge step before conducting the temperature measurement step on the planar heater zone, the discharge step including:

connecting the power supply line connected to the planar heater zone to ground to discharge the junction capacitance of the diode connected to the planar heater zone.

18. The method of claim 14, further comprising a zero point correction step before conducting the temperature measurement step on a planar heater zone, the zero point correction step including:

connecting the power supply line connected to the planar heater zone to the current measurement device, connecting all the other power supply line(s) to the electrical ground, connecting the power return line connected to the planar heater zone to the electrical ground, connecting each of the other power return lines to the first electrically isolated terminal, taking a current reading (zero point current) from the current measurement device.

19. The method of claim 18, wherein the current measurement step further includes subtracting the zero point current from the current reading of the reverse saturation current before calculating the temperature T of the planar heater zone.

* * * * *